US005580130A

United States Patent [19]

Williams et al.

[11] Patent Number: 5,580,130

[45] Date of Patent: Dec. 3, 1996

[54] SEAT FOR BLEACHERS

[75] Inventors: Gilbert J. Williams, Aptos, Calif.; Alan W. Jackson, Nanaimo, Canada

[73] Assignee: Bleacher Comfort Licensing, LLC., Vancouver, Canada

[21] Appl. No.: 291,156

[22] Filed: Aug. 16, 1994

[51] Int. Cl.[6] ..... A47C 15/00

[52] U.S. Cl. ..... 297/352; 297/252

[58] Field of Search ..... 297/344.22, 374, 297/376, 352, 252, 256.16, 322, 378.1; 403/DIG. 9; 24/517, 519; 248/227, 229, 231.7, 316.1; 108/142

[56] References Cited

U.S. PATENT DOCUMENTS

| | | | |
|---|---|---|---|
| 816,545 | 3/1906 | Field | 297/252 |
| 2,220,865 | 11/1940 | Hines | 297/352 X |
| 2,509,420 | 5/1950 | Burch | 155/133 |
| 2,536,157 | 1/1951 | Campanelli | 297/378.14 X |
| 2,736,365 | 2/1956 | Hines | 297/352 X |
| 3,026,142 | 3/1962 | Holloway | 297/352 X |
| 3,066,980 | 12/1962 | Clute | 297/252 |
| 3,377,966 | 4/1968 | Bates et al. | 297/344.22 X |
| 3,594,039 | 7/1971 | Harp | 297/252 |
| 3,994,529 | 11/1976 | Lippert | 297/252 |
| 4,045,834 | 9/1977 | Mason | 297/352 X |
| 4,781,413 | 11/1988 | Shumack | 297/252 |
| 5,067,771 | 11/1991 | Ellis | 297/378 |

FOREIGN PATENT DOCUMENTS

| | | | |
|---|---|---|---|
| 560834 | 9/1957 | Belgium | 297/252 |

*Primary Examiner*—Milton Nelson, Jr.

*Attorney, Agent, or Firm*—Carol D. Titus; Leary, Titus & Aiello; Limbach & Limbach

[57] ABSTRACT

An improved foldable stadium seat having a seat portion and a backrest. The stadium seat has adjustable hooks that can engage different width bleachers. The hooks also reverse to secure the backrest to the seat portion for easy carrying. The hooks have retention pins that engage securing holes to conveniently lock the hooks in their predetermined desired locations. The hooks can also serve as feet for an elevated chair for use on any flat surface.

21 Claims, 7 Drawing Sheets

SEAT FOR BLEACHERS

FIELD OF THE INVENTION

The present invention relates to stadium seats, and in particular, it relates to foldable stadium seats that attach to stadium bleacher seats so as to provide the user with a padded seat cushion and a padded backrest.

BACKGROUND OF THE INVENTION

Many stadiums today have bench seats (bleachers) instead of individual seats. Bleachers have traditionally been made of long wooden planks with no backrest. Many modern and refurbished stadiums use bleachers made of metal, still with no backrest.

Sitting on bleachers for long periods of time can be uncomfortable in two ways. First, the bleacher is hard and can be uncomfortable to sit on for long periods of time. Secondly, sitting on a seat with no backrest can strain the upper and lower back.

To help solve this problem, cushions can be placed on the hard wooden or metal surface. These cushions address the pain of sitting on a hard surface, but they do not address strain on the upper and lower back.

Prior art solutions to back pain in bleacher seating provided the user with a padded seat combined with a backrest. The most widely used design is a foldable seat that has a seat portion and a backrest that are foldably connected. Hook(s) on the seat portion engage the front underneath portion of the bleacher to allow the user to lean back in the seat and not tip backwards. The seat portion can have a single hook in the center of the seat portion, or there can be two hooks, as set forth in U.S. Pat. No. 2,509,420 and U.S. Pat. No. 3,066,980, with one hook on each side of the seat portion.

There are drawbacks to these designs, however. First, the hook openings must match the thickness of the bleacher. If the hook opening is too small, it will not engage the bleacher. If the hook opening is too large, then the user will tilt backwards until the hook engages the bottom of the bleacher, which is undesirable. Therefore, prior art designs can be used only with stadiums with bleacher thicknesses that match the size of their hook opening. The user cannot use a single seat in two different stadiums that have two different bleacher thicknesses. Or, if a stadium retrofits its bleachers with thicker bleacher widths, then the seat becomes obsolete.

There is a need for a stadium seat that can effectively be used with varying thicknesses of bleachers.

Another drawback to the prior art devices is that they do not adequately secure the backrest to the seat portion for easy carrying when the stadium seat is in its folded/closed position. Some designs use the hook under the seat to engage a loop on the backrest, or to engage the backrest itself. But those designs fail to securely hold the backrest to the seat portion securely in a manner whereby the hooks cannot inadvertently become undone.

There is a need to provide an easy and effective way to secure the backrest to the seat portion for easy carrying when the seat is in its folded position.

SUMMARY OF THE INVENTION

The foregoing problems have been overcome by present invention, which is an improved foldable stadium seat. The improved stadium seat has a seat assembly comprising a seat pad secured to two parallel, spaced apart, seat rods. A backrest assembly, comprising a backrest pad secured to two parallel, spaced apart, backrest rods, is swingably attached to the seat assembly by a hinge.

The seat has two positions, an open position and a closed position. In the open position, the seat assembly and the backrest assembly form an approximate right angle. To put the stadium seat in its closed position, the backrest assembly swings toward the seat assembly so that the backrest pad lies flat against the seat pad.

There are two U-shaped hooks each having a spring loaded retention pin protruding from one side of the U. The seat rods are hollow in the ends farthest away from the hinge such that the one side of each U-hook with the retention pin inserts into the seat rods. The U-hooks rotate about the seat rods.

There are a series of retention pin holes in a line around each of the U-hooks whereby the retention pin protrudes through one of the retention pin holes to engage a securing hole in the seat rod thereby fixing the angular position of the U-hook relative to the seat pad. Each retention pin hole position represents a different desired angular position of the U-hooks as they rotate relative to the seat rods. Changing this angle changes the effective width of the opening between the hook end and the seat pad. Therefore, hooks can be set to properly engage different bleachers having different thickness by changing and locking in different U-hook angles.

In the closed position, the seat and seat back are locked together by means of a detente in the U-hook that engages the corresponding back rest rod. By compressing the seat and seat back together, the U-hook can be rotated to disengage the back rest rod and thus allowing the seat back to swing out of its closed position.

In an alternate embodiment, the stadium seat has 4 U-hooks, one on each corner of the seat. The 4 U-hooks can fully secure the seat to the bench for activities such as rowing a row boat. The 4 U-hooks can also serve as feet for an elevated seat for use on any flat surface.

This seat is advantageous over the prior art because the effective hook opening can be changed and locked to match different bleacher thickness. Further, the seat utilizes the hooks to secure the backrest to the seat pad when the seat is in its closed position.

DETAILED DESCRIPTION OF THE PREFERRED EMBODIMENTS

Figure 1:
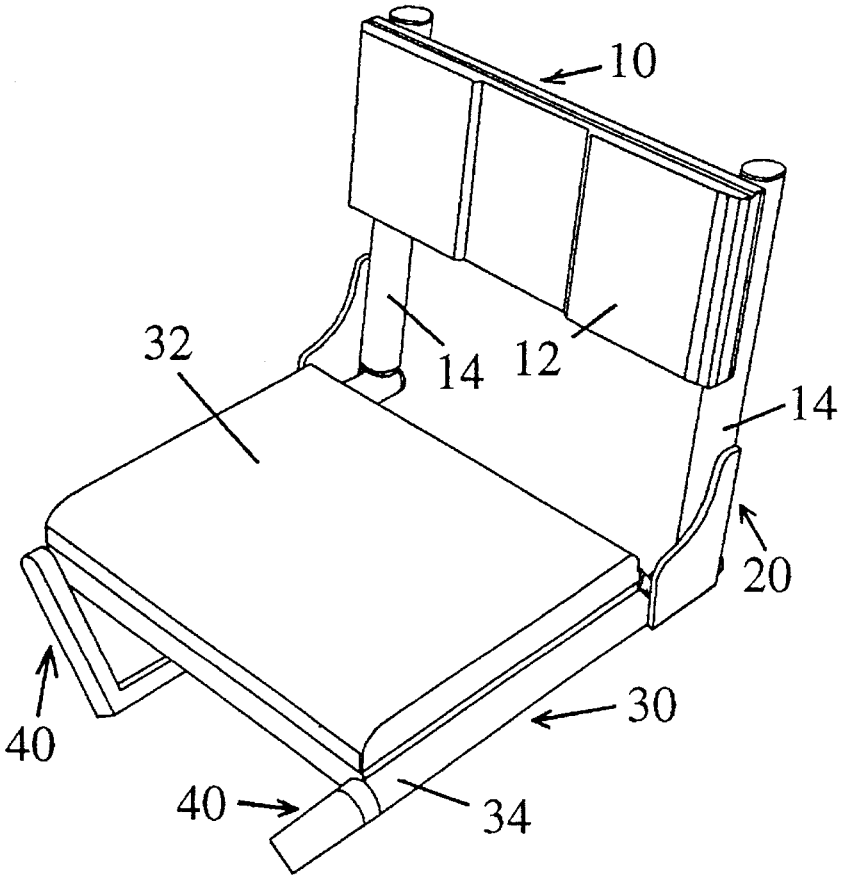
FIG. 1 is an elevated perspective view of the foldable stadium seat in its open position.
Figure 2:
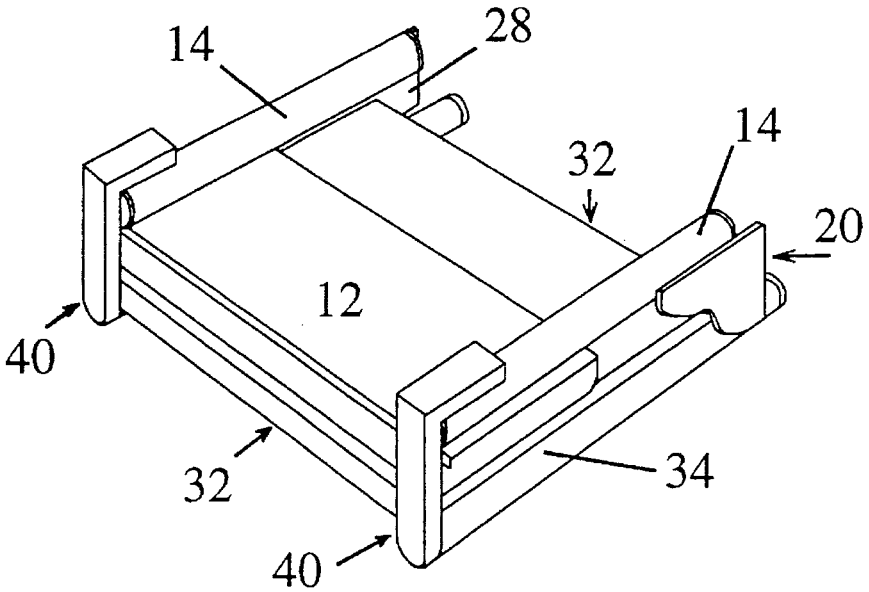
FIG. 2 is an elevated perspective view of the foldable stadium seat in its closed and locked position.
Figure 3:
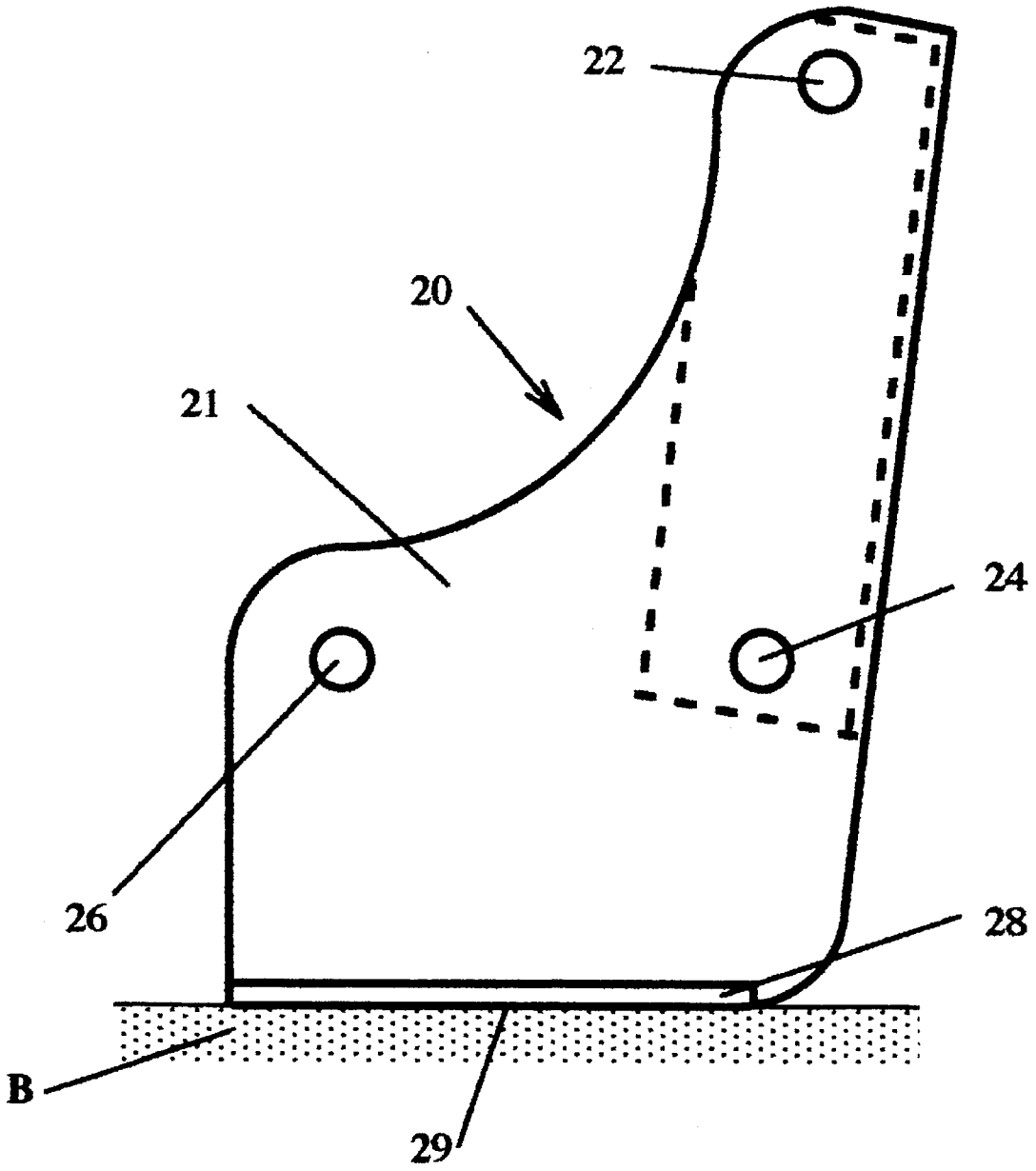
FIG. 3 is a side view of the hinge plate of the seat.

Referring to FIGS. 1 and 2, the preferred embodiment of the stadium seat is designated in its entirety by the number 1. The stadium seat 1 has a backrest assembly 10, a hinge 20, and a seat assembly 30.

The backrest assembly 10 has a backrest pad 12 and two parallel spaced apart backrest rods 14. The backrest pad 12 can be made of any rigid material. Preferably the front surface of the backrest pad 12 is padded for comfort.

The backrest rods 14 are attached to the backrest pad 12 and extend down to the hinge 20. The backrest pad 12 is most comfortable when it does not extend all the way down the backrest rods 14 to the hinge means 20.

The seat assembly 30 has a seat pad 32 and two parallel spaced apart seat rods 34 which are attached to the underneath surface of the seat pad 32 and held in a substantially parallel configuration. The seat pad 32 can be made of any rigid material and is preferably padded on its top surface for comfort.

The hinge 20 is illustrated in FIGS. 3, 4, 6A and 6B. The preferred embodiment uses two hinges 20, one for each side of the stadium seat 1. Each of the hinges 20 includes a hinge plate 21 which is bolted, riveted, or otherwise attached to the backrest rods 14 through boltholes 22 and 24, and pivotally connected to the seat rods 34 at bolthole 26.

The hinge plate 21 has a semicylindrical channel adaptor 27 into which the back rest rod 14 nests when it is attached to the hinge plate 20 to provide a superior means to secure the back rest rod 14 to the hinge 20.

The hinge plate 21 has a horizontal gusset 28 on its bottom surface that extends away from the seat rod. The gusset 28 has a bottom surface 29 that contacts the top surface of bleacher seat B during use to prevent the stadium seat 1 from sliding forward once it is engaged onto the bleacher.

When the stadium seat 1 is in its open position, the hinge 20 secures the backrest assembly 10 relative to the seat assembly 30 such that the two assemblies form an angle that is slightly larger than 90 degrees. The hinge 20 pivots around bolthole 26 such that the backrest pad 12 tilts forward until it lays flat against the seat pad 32. When the stadium seat 1 is in this closed position, the seat rods 34 and the backrest rods 14 are substantially parallel to each other. While it is desirable to have a hinge design that allows the backrest to lay flat against the seat pad by making the seat rods and backrest rods parallel in the folded position, it is not necessary to the design of the chair.

Figure 4:
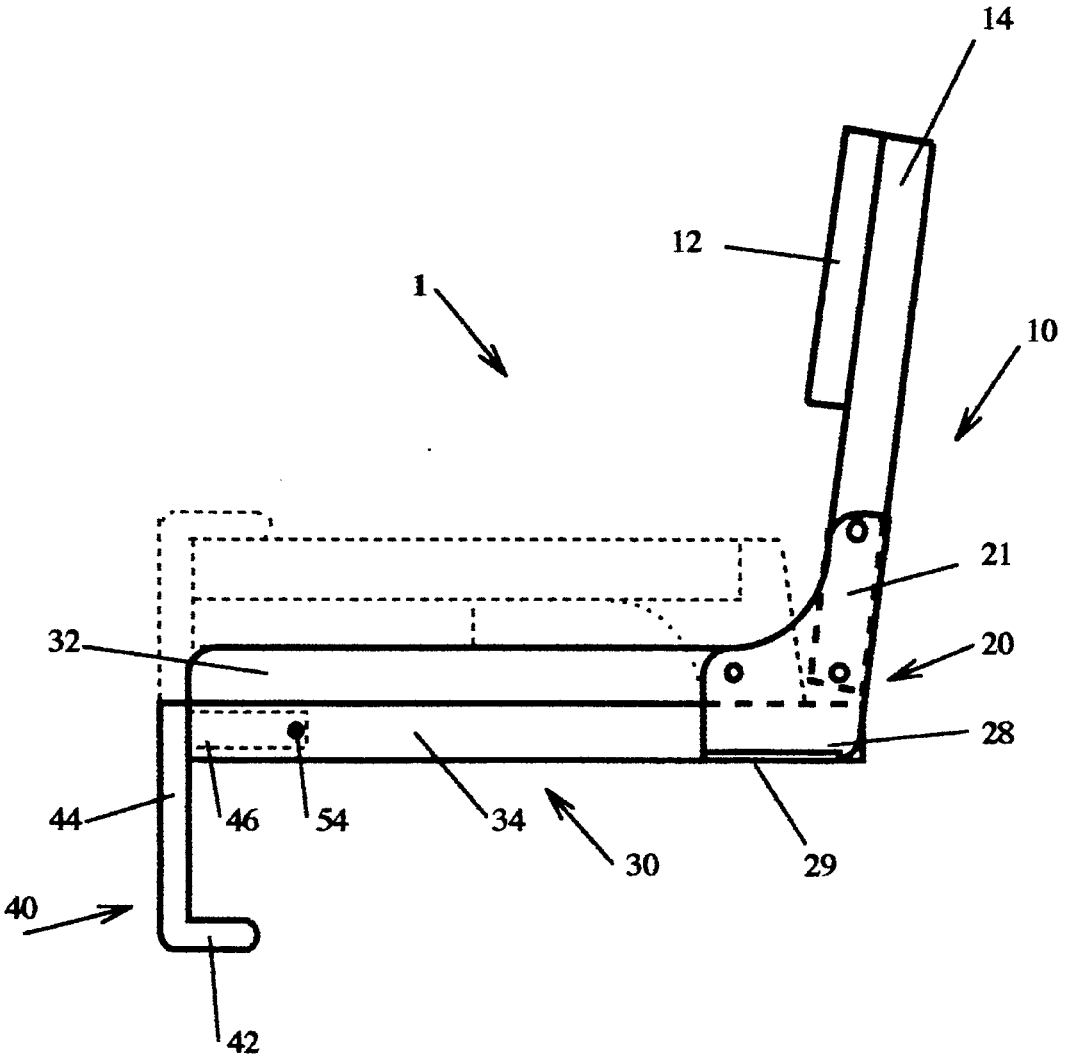
FIG. 4 is a composite side view showing the stadium seat in its open position and in phantom in its closed position.

The stadium seat 1 is held in place on the bleacher seat by two U-hooks 40 at the front of the seat assembly as illustrated in FIGS. 4–5. The U-hook 40 has three sections: the bleacher hook portion or side 42, the extension portion 44, and the swivel portion or side 46. The bleacher hook portion 42 engages the bottom front side of the bleacher B to prevent the stadium seat 1 from moving or tilting backwards during use. The extension portion 44 has a length equal to the thickness of the thickest bleacher intended to be used with the stadium seat 1. The preferred embodiment has an extension portion 44 with a length of 2.75 inches, which is the width of a standard metal bleacher.

The swivel portion 46 is round and has an outside diameter slightly less than the inside diameter of the seat rods 34. The ends of the seat rods 34 opposite from the hinges 20 are hollow such that the swivel portion 46 of the U-shaped hooks 40 inserts therein. The U-hooks 40 rotate about the seat rod 34 such that the effective opening between the side portion 42 of the U-hook 40 and the seat rods 34 can be reduced to accommodate smaller bleacher thicknesses, as illustrated in FIG. 5B.

Figure 5A:
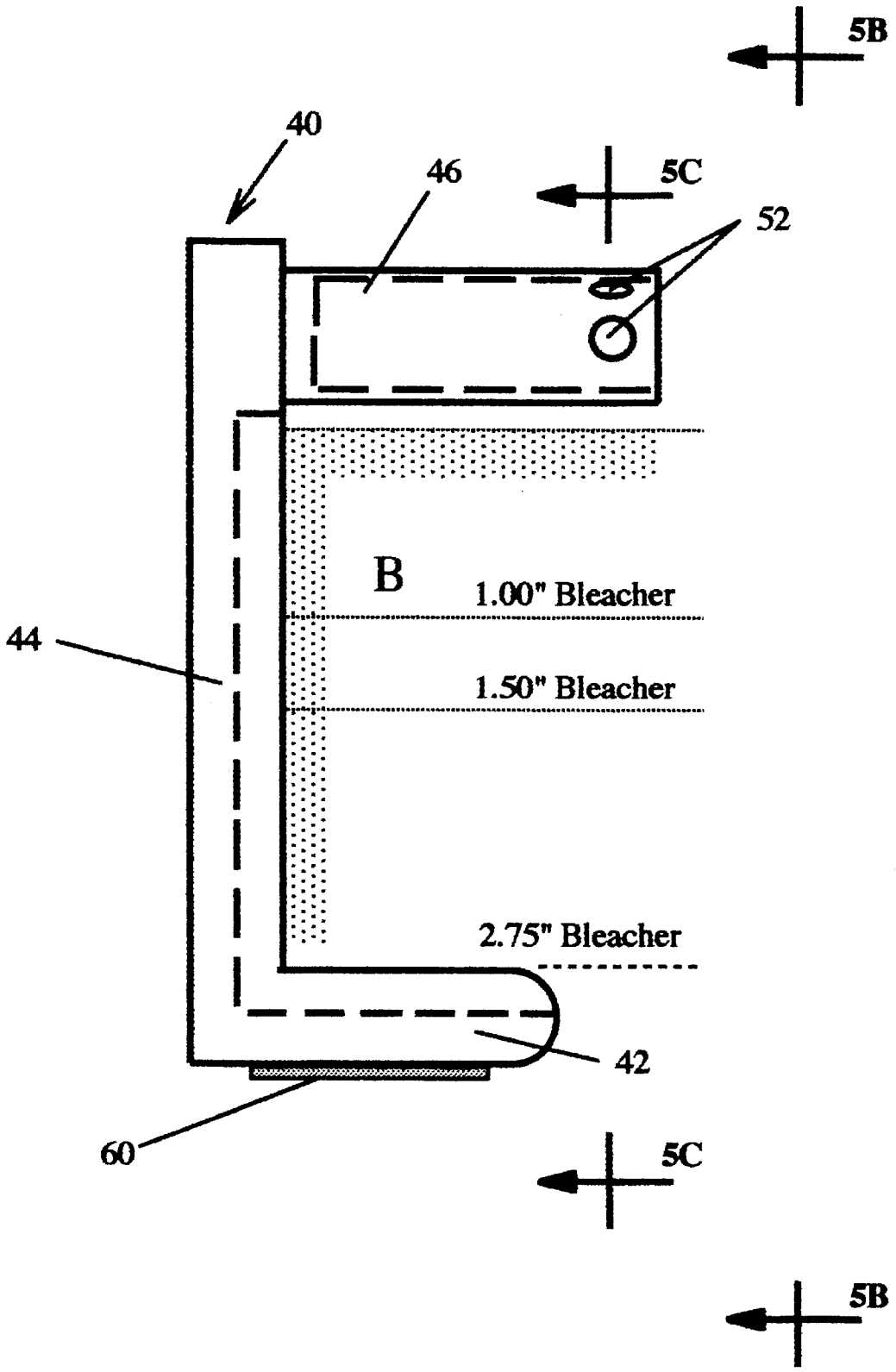
FIG. 5A is a side schematic view illustrating how the U-hook engages a thick bleacher seat.
Figure 5B:
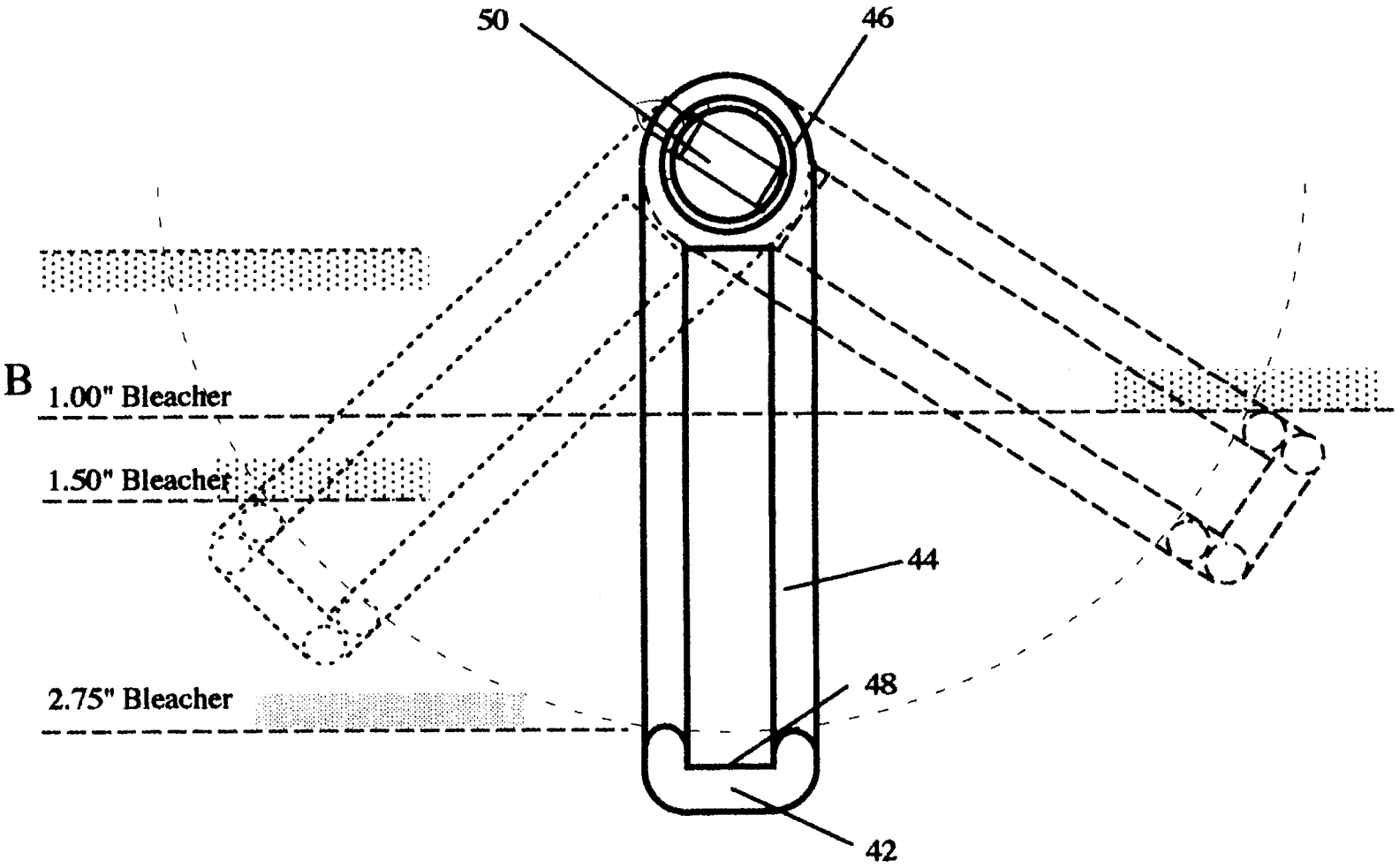
FIG. 5B is an end view of the hook in FIG. 5A taken along line 5B—5B in the direction of the arrows and illustrating in phantom the position of the hook for a thinner bleacher seat.
Figure 5C:
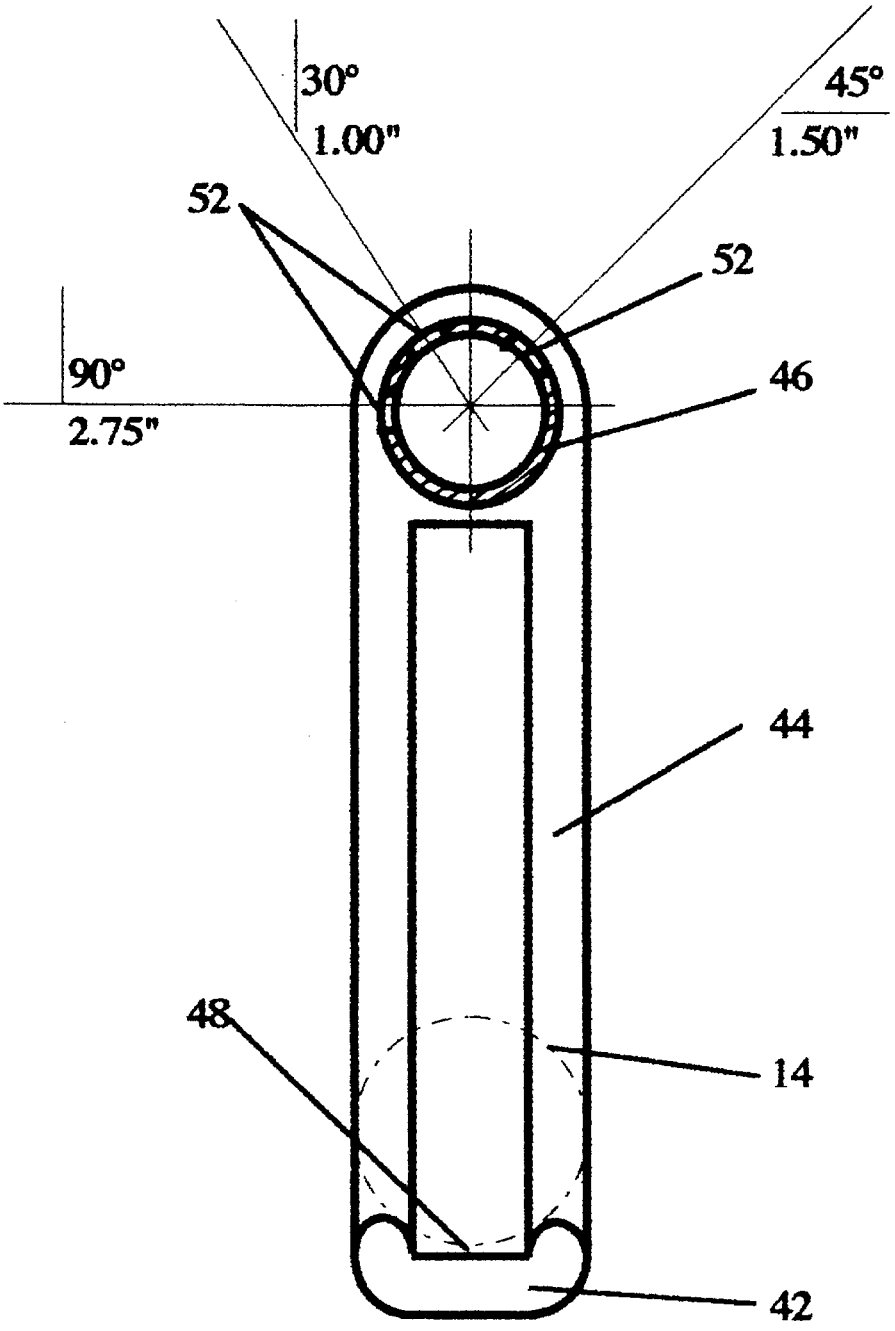
FIG. 5C is a cross sectional view of a portion of the structure shown in FIG. 5A taken along line 5C in the direction of the arrows.

The swivel or side portion 46 has a spring loaded retention pin 50 that protrudes from the side of the swivel side portion 46 adjacent to the end of the U-shaped hook 40, through one of three retention pin holes 52, as illustrated in FIGS. 5A–5C. The retention pin 50 is flush with the swivel portion 46 of the U-hook 40 when sufficient inward pressure is exerted onto the pin 50.

The U-hooks 40 have three retention pin holes 52 in a line around the swivel portion 46 as shown in FIG. 5C. The retention pin 50 protrudes through a retention pin hole 52 to engage a securing hole 54 in the seat rod 34, which secures the angular position of the U-hooks 40 as they rotate about the seat rods 34. The three retention pin holes 52 are positioned such that the U-hooks 40 alternately have effective opening widths from the seat rods of 1.00 inches, 1.50 inches, or 2.75 inches (when the U-hooks are fully extended downwards).

The preferred embodiment has two opposing securing holes 54 substantially in the horizontal plane, and retention pin holes 52 as illustrated in FIG. 5C. The retention pins use one securing hole for the 90° and 30° positions, and the other securing hole for the 45° position.

Figure 7:
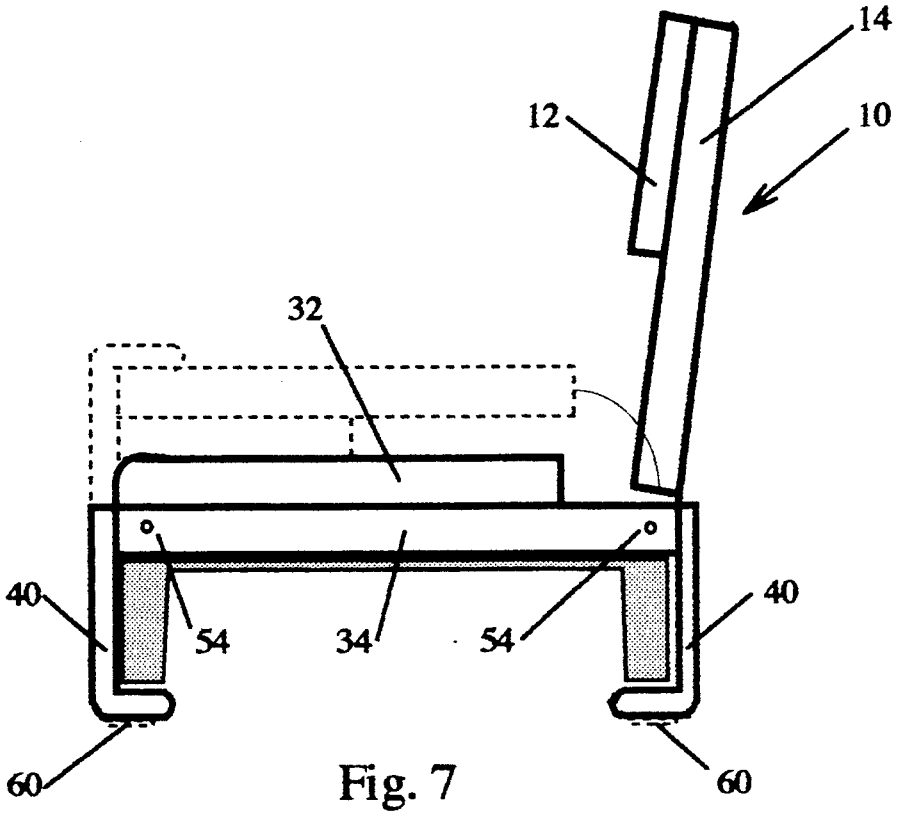
FIG. 7 is a composite side view of the stadium seat illustrating the alternate embodiment having four U-hooks.
Figure 6A:
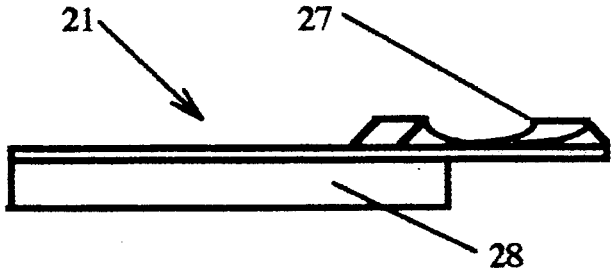
FIG. 6A is a top view of the hinge.
Figure 6B:
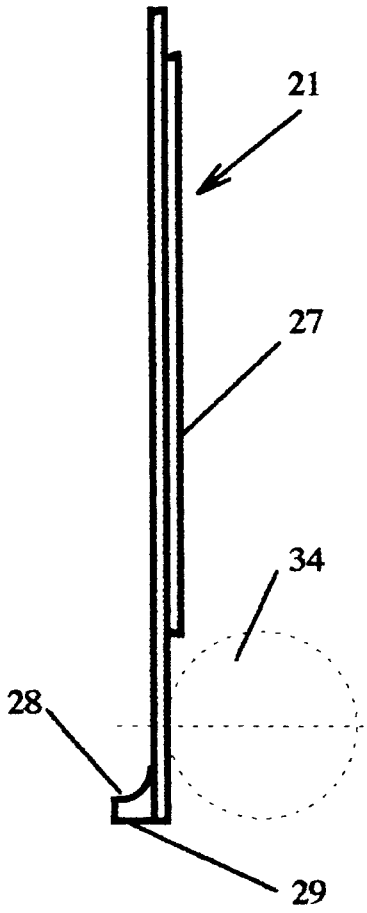
FIG. 6B is a rear elevational view of the hinge plate.

The U-hooks 40 swivel around such that they engage the backrest rods 14 when the stadium seat 1 is in its closed position, as illustrated in FIG. 2, and as illustrated in phantom in FIGS. 4 and 7. U-hooks 40 have detents 48 that engage the backrest rods 14. The U-hooks securely hold the backrest rods 14 in place, which in turn secures the stadium seat 1 in its closed position. The stadium seat 1 can be conveniently carried in the closed and locked position whereby the user cannot inadvertently unlock and unfold the seat without first disengaging the U-hooks 40 from the backrest rods 14. By compressing the backrest and seat pads 12 and 32 together, detente 48 can be swiveled away from the backrest rods 14 to unfold the seat 1 into operable position.

While the preferred embodiment has only 3 retention pin holes 52 on each U-hook 40, the number of retention pin holes 52 and their positions can be varied depending on the number of bleacher thicknesses the user wants to accommodate and the thicknesses of those bleachers.

In the event that bleacher seats are built that have different widths from the front to the back, different sets of holes 54' can be provided along the length of either the seat rods 34 or the U-hooks 40 to accommodate different lengths of the swivel portion 46 inside the seat rods 34 to accommodate the different bleacher seat widths.

In an alternate embodiment, the stadium seat 1 has four U-hooks 40, as illustrated in FIG. 7. The opposing four U-hooks 40 have two purposes. First, four U-hooks 40 secure the stadium seat around both sides of a bleacher seat for added stability. This embodiment is especially good for use on row boats that have bleacher type seats. Second, rubber pads 60 can be added to the outside bottom surface of the U-hooks 40, as illustrated in FIG. 5A. When all four U-hooks are in their downward position, the seat can be placed on any flat surface and used as an elevated seat. This is especially useful for outdoor uses such as backpacking.

It is to be understood that the present invention is not limited to the sole embodiment described above and illustrated herein, but encompasses any and all variations falling within the scope of the appended claims.

What is claimed as the invention is:

1. A foldable stadium seat for mounting on a bleacher seat comprising:

a seat assembly having a front portion, a back portion and a seat pad attached to at least a pair of parallel spaced apart seat rods extending from adjacent said front portion to adjacent said back portion of said seat assembly, wherein at least the ends of said seat rods adjacent said front portion of said seat assembly are hollow and have at least one securing hole therein, a back rest assembly foldably attached to said seat assembly adjacent said back portion thereof and moveable between a sitting position at an angle to said seat pad and a folded position substantially flat against said seat pad, and an attachment means that swingably attaches one side of each of a pair of U-shaped hooks to said seat assembly such that the angle between said hooks and said seat assembly can be fixed at one of a number of predetermined angles, said pair of U-shaped hooks each having said one side of the U slidably inserted in said hollow end of one of said seat rods, said pair of U-shaped hooks having a series of retention pin holes along a line around said one side of said U-shaped hook, and said pair of U-shaped hooks having a spring-loaded retention pin protrudable from said retention pin holes and engageable through said securing hole, said retention pin being rotatable inside said U-hook to protrude through any selected one of said retention pin holes such that said retention pin can engage said securing hole to secure said hook at predesignated angles relative to said seat pad.

2. A foldable stadium seat as recited in claim 1 further comprising a detent in said U-hooks located to engage said back rest assembly to clamp said seat assembly and said backrest assembly flat against each other.

3. A foldable stadium seat as recited in claim 1 including another set of holes along the length therein in at least one of said seat rods and said U-hooks whereby different lengths of said U-hooks are engaged inside said seat rods so as to accommodate different width bleachers.

4. A foldable stadium seat as recited in claim 1 including hinge means for swingably attaching said seat rods to said back rest assembly.

5. A foldable stadium seat as recited in claim 4 wherein said hinge means has a horizontal gusset with a flat surface that extends away from said seat assembly such that said horizontal gusset flat surface lies flat against the top surface of the bleacher seat during use.

6. A foldable stadium seat as recited in claim 1 wherein said U-hooks each have at least a first, a second, and a third retention pin hole located such that said retention pin alternately protrudes through said first, second and third retention pin holes and engages said securing hole to alternately position the other side of said hook below the seat assembly to clamp the stadium seat to bleacher seats of different thickness.

7. A foldable stadium seat as recited in claim 6 wherein said first retention pin hole is located such that when said retention pin protrudes therefrom to engage said securing hole, the other side of one of said hooks is positioned below said seat assembly to clamp the stadium seat to a bleacher seat having a thickness of substantially 1.00 inches, said second retention pin hole is located such that when said retention pin protrudes therefrom to engage said securing hole, said other side of one of said hooks is positioned below said seat assembly to clamp the stadium seat to a bleacher seat having a thickness of substantially 1.50 inches, and said third retention pin hole is located such that when said retention pin protrudes therefrom to engage said securing hole, said other side of one of said hooks is positioned below said seat assembly to clamp the stadium seat to a bleacher seat having a thickness of substantially 2.75 inches.

8. A foldable stadium seat as recited in claim 7 wherein said one side of said U-shaped hook containing said retention pin is longer than the other side of said U-shaped hook.

9. A foldable stadium seat as recited in claim 1 further comprising:

said seat rods being hollow at the ends adjacent to said back portion of said seat assembly and having at least one second securing hole therein, and a second pair of U-hooks each having one side of the U slidably inserted in said hollow end of one of said seat rods adjacent to said back portion of said seat assembly and having a series of retention pin holes along a line around said one side of said U-shaped hook, and having a spring-loaded retention pin protrudable from said retention pin holes and engageable through said second securing hole said retention pin being rotatable inside said second pair of U-hooks to protrude through any selected one of said retention pin holes such that said retention pin can engage said second securing hole to secure said hook at predesignated angles relative to said seat pad.

10. A foldable stadium seat as recited in claim 9 wherein an opposite side of said insertable side of said U-hooks has a rubber pad affixed for contact with a flat surface during use.

11. A foldable stadium seat for mounting on a bleacher seat comprising:

first and second backrest rods, each of said backrest rods having a first and a second end, a backrest pad secured to said backrest rods in a substantially parallel position, first and second seat rods, each of said seat rods having a first and a second end, a seat pad secured to said seat rods in a substantially parallel position, first hinge means that swingably connects said first end of said first backrest rod to said first end of said first seat rod, second hinge means that swingably connects said first end of said second backrest rod to said first end of said second seat rod, said first and second hinge means allowing said backrest pad to fold together and substantially flat against said seat pad in a closed position and said backrest pad to fold apart from said seat pad to substantially form a right angle therefrom in an open position, first and second U-shaped hooks, one side of each of said hooks containing a series of retention pin holes along a line around said one side and a spring loaded retention pin protruding through one of said retention pin holes, said seat rods being hollow at their said second ends and each having at least one securing hole such that said one sides of said hooks with said spring loaded retention pins are insertable inside said seat rods whereby said retention pins engage said securing holes to secure said hooks at predesignated angles relative to said seat pad.

12. A foldable stadium seat as recited in claim 11 including another set of holes along the length therein in at least one of said seat rods and said U-hooks whereby different lengths of said U-hooks are engaged inside said seat rods so as to accommodate different width bleachers.

13. A foldable stadium seat as recited in claim 11 further comprising:

said first and second seat rods being hollow at said first ends and having at least one second securing hole therein, third and fourth U-shaped hooks, one side of each of said hooks containing a series of retention pin holes along a line around said one side and a spring loaded retention pin protruding through one of said retention pin holes, said seat rods being hollow at their said first ends and each having at least one securing hole such that said one sides of said hooks with said spring loaded retention pins are insertable inside said first ends of said seat rods whereby said retention pins engage said second securing holes to secure said hooks at pre-designated angles relative to said seat pad.

14. A foldable stadium seat as recited in claim 13 wherein said first, second, third and fourth U-hooks each have a rubber pad affixed to an opposite side of said one side of said U-hooks with said retention pins for contact with a flat surface during use.

15. A foldable stadium seat as recited in claim 11 wherein said first and second hinge means contain a horizontal gusset that extends away from said seat pad for engaging the top side of the bleacher seat during use.

16. A foldable stadium seat as recited in claim 15 wherein said first and second hinge means secures said backrest rods parallel to said seat rods when said seat is in its folded position such that said backrest pad lies flat against said seat pad.

17. A foldable stadium seat as recited in claim 16 wherein said one side of said hooks each have a first, a second and a third retention pin hole positioned such that said retention pin engages said securing hole whereby said hooks properly engage a shallow stadium bleacher with a width of 1.50 inches when said retention pins are engaged in said first retention pin holes, said hooks properly engage a deep stadium bleacher with a width of 2.75 inches when said retention pins are engaged in said second retention pin holes, and said hooks properly engage a boat platform with a width of 1.00 inches when said retention pins are engaged in said third retention pin holes.

18. A foldable stadium seat as recited in claim 16 wherein said one side of each of said U-shaped hooks containing the retention pin is longer than the other side of said U-shaped hook.

19. A foldable stadium seat for mounting on a bleacher seat comprising:

a seat assembly having a front portion, a back portion and a seat pad attached to at least a pair of parallel spaced apart seat rods extending from adjacent said front portion to adjacent said back portion of said seat assembly, a back rest assembly foldably attached to said seat assembly adjacent said back portion thereof and moveable between a sitting position at an angle to said seat pad and a folded position substantially flat against said seat pad, and an attachment means that swingably attaches a first side of each of a pair of U-shaped hooks to said seat assembly such that the angle between said hooks and said seat assembly can be fixed at a plurality of bench engagement angles.

20. The foldable stadium seat of claim 19 wherein each of said U-shaped hooks has a second side, said second side serving to hold said foldable stadium seat adjacent said bleacher seat.

21. The foldable stadium seat of claim 19 wherein said U-shaped hook has a first position, said first position having said U-hook locked into a chosen angle with respect to said seat pad such that the vertical distance measured between said first side and a second side of said U-hook is a predetermined distance chosen to fit a chosen bench.

* * * * *